US005233762A

United States Patent [19]

Müller et al.

[11] Patent Number: 5,233,762

[45] Date of Patent: Aug. 10, 1993

[54] RADIATOR UNIT FOR DRYING AND/OR HARDENING COATINGS OF INKS AND/OR VARNISHES IN PRINTING PRESSES

[75] Inventors: Rolf Müller, Nussloch; Josef Reiter, Heidelberg, both of Fed. Rep. of Germany

[73] Assignee: Heidelberger Druckmaschinen AG, Heidelberg, Fed. Rep. of Germany

[21] Appl. No.: 677,125

[22] Filed: Mar. 29, 1991

[30] Foreign Application Priority Data

Mar. 30, 1990 [DE] Fed. Rep. of Germany ..... 4010191

[51] Int. Cl.[5] ..... F26B 3/28

[52] U.S. Cl. ..... 34/1 A; 34/1 Y

[58] Field of Search ..... 34/4, 60, 41, 155, 156, 34/1 A, 1 Y, 1 W, 1 K, 18, 113; 219/10.61 R

[56] References Cited

U.S. PATENT DOCUMENTS 4,312,137 1/1982 Johne et al. ..... 34/4 X
4,646,446 3/1987 Bubley .
4,882,853 11/1989 Schaft .

FOREIGN PATENT DOCUMENTS 112460 6/1918 United Kingdom .

OTHER PUBLICATIONS

Publication Applied Physics B, Springer Verlag 1988, Appl. Phys. B 46, 299-303 (1988); B. Eliasson et al: "UV Excimer Radiation from Dielectric-Barrier Discharges".

*Primary Examiner*—Henry A. Bennet
*Attorney, Agent, or Firm*—Herbert L. Lerner; Laurence A. Greenberg

[57] ABSTRACT

A radiator device for drying and/or hardening coatings of ink and/or varnish in a printing press, includes a high-power radiator having an electrode pair connected to an alternating-current voltage source, and a wall intermediate the pair of electrodes and defining a gas-filled discharge space, the wall being formed of dielectric material and being transparent to radiation generated in the discharge space, the wall of dielectric material being disposed in direct vicinity of one of the two electrodes, so that electrical energy capacitively injected from the one electrode into the discharge space causes additional discharges outside of the discharge space, the additional discharges having a catalytic effect on the drying and/or hardening process.

4 Claims, 3 Drawing Sheets

RADIATOR UNIT FOR DRYING AND/OR HARDENING COATINGS OF INKS AND/OR VARNISHES IN PRINTING PRESSES

The invention relates to a radiator unit or radiation-lamp device for drying and/or hardening coatings of ink and/or varnish in a printing press with a high-power radiator or radiation lamp, preferably an excimer radiator having a gas-filled discharge space defined by walls, of which at least one is formed of a dielectric material and is transparent to the radiation produced in the discharge space, and an electrode pair connected to an alternating-current voltage source.

At the high operating speeds of web- and sheet-fed printing presses, there is a danger that the printing inks applied to the web or to the sheet will not have been dried yet by the time the web or the sheet, in the course of its further transport, comes into contact with parts of the press or with other printed products. A consequence thereof otherwise is a setting-off o smearing of the printing ink. Either result represents a considerable and by no means tolerable deterioration in the quality of the printed products.

In sheet-processing printing presses, these problems are, for the most part, kept within limits in that the sheet-carrying outer cylindrical surfaces of the transfer cylinders between the individual printing units and, in particular, the outer cylindrical surface of an impression cylinder disposed after or downstream from a sheet-turning device are formed of ink-repellent material. With respect to sheet-fed printing presses, it is also conventional to dispose a radiator device in the delivery area for drying the printing ink on the sheets before they are deposited on the delivery pile. In web-fed printing presses, the freshly printed web, prior to its further processing, passes through a dryer, which is integrated into the printing press.

A conventional type of radiator or radiation lamp is presented in the book "Photopolymerization of Surface Coatings", by C. G. Roffey, published by: Wiley & Sons, 1982, Chapter 2. The medium-pressure mercury vapor arc lamp or radiator described therein exhibits disadvantages, however, which make its use possible only to a limited extent in printing presses for drying printed products. Thus, this type of radiator or radiation lamp has a relatively low efficiency with regard to the generation of ultraviolet (UV) radiation. A majority of the energy is emitted in the form of infra-red (IR) radiation. Because temperature has a great effect upon the rheological properties of the printing ink, particularly in offset printing, it is of utmost importance, with regard to maintaining a consistently high print quality, that fluctuations in temperature should be largely prevented during a printing run. It is essential, therefore, to cool the radiator or radiation lamp, which represents a considerable additional outlay of equipment.

A further disadvantage of this heretofore known medium-pressure mercury arc vapor radiator or radiation lamp is that it is not ready for operation until approximately 15 minutes after it has been initially switched on or after it has been switched on again following a switch-off, a disadvantage which is not compatible with a desire for optimum utilization of a printing press.

High-power UV and VUV radiator devices or radiation lamps having a high efficiency are described in the magazine article "UV Excimer Radiation from Dielectric-Barrier Discharges" by B. Eliasson and U. Kogelschatz in Applied Physics B 46, pages 299–303 (1988). In this excimer radiator device or radiation lamp, the UV radiation is produced by means of a so-called silent discharge. For this purpose, a filler gas is preferably a noble gas, a noble-gas mixture or a noble-gas/halogen mixture. At least one of the walls of the radiation lamp lying parallel to the plane of the product to be treated is formed of a dielectric material, such as quartz glass or transparent quartz, which is pervious to or penetrable by the UV radiation produced in the discharge space. The excimer radiation is excited by a high voltage which is applied to two electrodes outside the discharge space. At least one of the electrodes is in the form of a wire network or grid, so that the UV radiation can penetrate into the so-called treatment space.

Proceeding from this state of the prior art, it is accordingly an object of the invention to provide a radiator unit for drying and/or hardening coatings of inks and/or varnishes in printing presses which would accomplish its objective in a minimum of time.

With the foregoing and other objects in view, there is provided in accordance with the invention, a radiator device for drying and/or hardening coatings of ink and/or varnish in a printing press, comprising a high-power radiator having an electrode pair connected to an alternating-current voltage source, and a wall intermediate the pair of electrodes and defining a gas-filled discharge space, the wall being formed of dielectric material and being transparent to radiation generated in the discharge space, the wall of dielectric material being disposed in direct vicinity of one of the two electrodes, so that electrical energy capacitively injected from the one electrode into the discharge space causes additional discharges outside of the discharge space, the additional discharges having a catalytic effect on the drying and/or hardening process.

With regard to the drying and/or hardening of inks and/or varnishes, it has been found that so-called external discharges, i.e., discharges outside the actual discharge space, occur in normal ambient air under the influence of UV radiation. The reaction products of these external discharges, which are mainly ozone and nitrogen, exert an absolutely unforeseeable effect on the drying and/or hardening process of the ink and/or varnish coating on a web or sheet. For optimum operation, it is necessary for the radiation escaping from the discharge space not to be absorbed by the reaction products. This requirement does not constitute a major problem, because it is possible within broad limits freely to select the wavelength range of excimer radiation by a suitable choice of the filler gas.

In accordance with another feature of the invention, the radiator is a planar excimer radiation lamp and the one electrode is a grid electrode connected under high voltage and is disposed in direct vicinity of a location at which an ink and/or varnish coating to be hardened is disposed.

In accordance with a further feature of the invention, the location at which the coating of ink and/or varnish to be hardened is disposed is at ground potential.

In this regard, a cylinder of the printing press which carries the printed product to be dried is connected to ground potential while the grid electrode situated on the side of the radiator device facing towards the cylinder is under high voltage. In such an arrangement, the cylinder forms a potential sink, which ensures that all charged reaction products in the air gap between the dielectric wall and the electrode facing the outer surface of the cylinder flow in a direction towards the cylinder and reach the ink and/or varnish surface coating that is to be hardened.

In accordance with another object of the invention, the radiator device for drying and/or hardening coatings of ink and/or varnish in a printing press comprises a wall formed of dielectric material and a wall formed as an electrode defining therebetween a gas-filled discharge space, and a grid electrode disposed in ambient atmosphere adjacent to the wall formed of dielectric material and at a side thereof facing away from the wall formed as an electrode, the discharge space being filled with gas electrically energizable to produce UV radiation, means for applying alternating-current voltage to the electrode for injecting electrical energy capacitively into the discharge space for producing UV radiation and causing additional discharges in the ambient atmosphere having a catalytic effect on a drying and/or hardening of a coating of ink and/or varnish.

In accordance with an added feature of the invention, there is provided, in a printing press having a plurality of printing units with respective impression cylinders, at least one radiator device assigned to each of the impression cylinders.

In accordance with an additional feature of the invention, there are provided turning drums and a delivery, and at least another radiator device assigned to the turning drums and the delivery.

In accordance with a concomitant feature of the invention, there are provided means for selectively switching the radiator devices on and off.

The foregoing last-mentioned further developments of the device according to the invention thus relate to the arrangement of the radiator devices in the printing press, it being possible for the first time to integrate them into the printing units due to the extremely efficient method of operation of excimer radiation lamps.

Other features which are considered as characteristic for the invention are set forth in the appended claims.

Although the invention is illustrated and described herein as embodied in a radiator unit for drying and/or hardening coatings of inks and/or varnishes in printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF DRAWINGS

Figure 1:
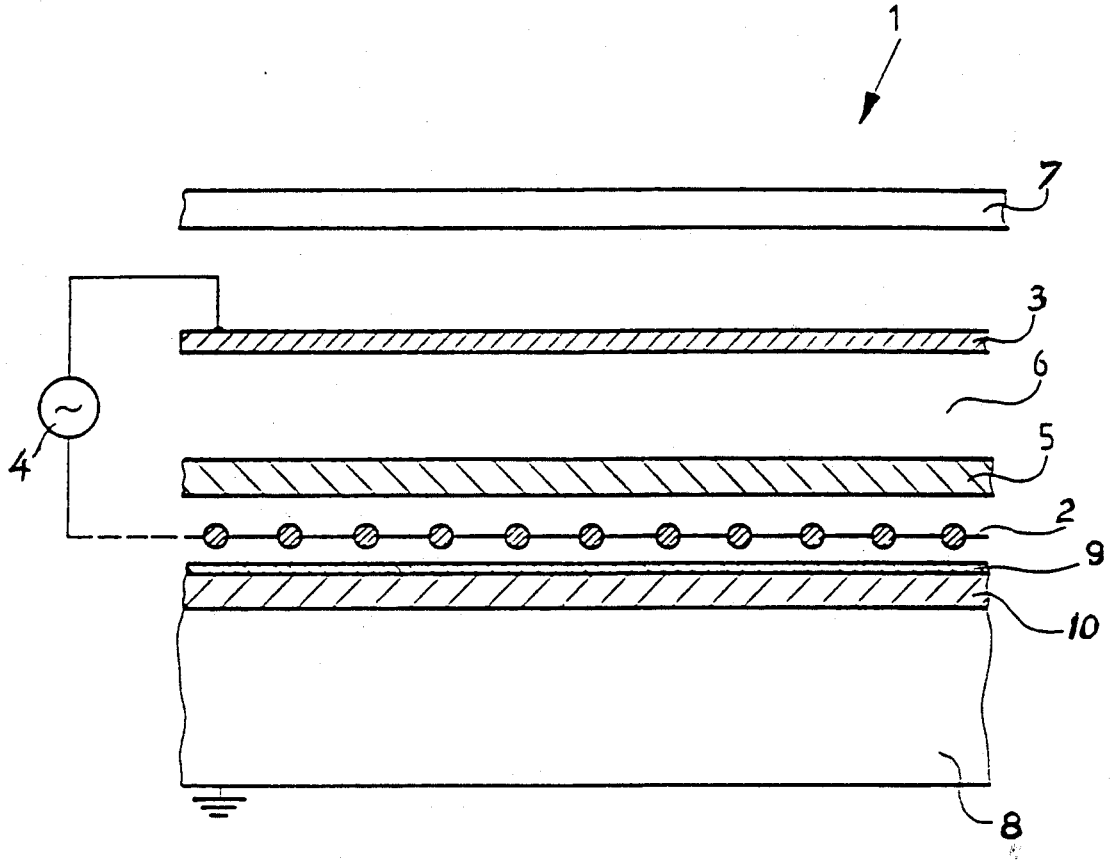
FIG. 1 is a diagrammatic cross-sectional view, partly schematic, of a radiator device or radiation-lamp appliance formed as a flat or planar radiator radiating from one side thereof.

Referring now to the drawing and, first, particularly to FIG. 1 thereof, there is shown in a cross-sectional view a radiator device or radiation-lamp appliance 1 according to the invention in the form of a planar radiator or flat-beam radiation lamp radiating from one side thereof. Basically, the radiator device 1 is made up of electrodes 2 and 3, which are connected to an a-c voltage source 4 which is basically the equivalent of those used to supply conventional ozone generators.

A discharge space 6 is defined by the electrode 3 and a dielectric wall 5 disposed parallel thereto and formed, for example, of a quartz sheet or plate. The radiator device 1 is closed off against the outside by a limiting wall 7. The electrode 2 of the radiator device 1, which is a grid electrode, is disposed in the direct vicinity of a cylinder 8 of the printing press and thus in the direct vicinity of a substrate or carrier material 10 such as a paper sheet, which has been printed with an ink and/or varnish coating 9. The ink and/or varnish coating 9 to be hardened contains ultraviolet (UV) hardening substances with photo-initiators. Because the cylinder 8 carrying the sheet or substrate material 10 is connected to ground potential, i.e. constitutes a potential sink, assurance is provided that all charged reaction products in the air gap between the dielectric wall 5 and the electrode 2 facing towards the outer surface of the cylinder 8 flow towards the cylinder 8 and also reach the ink and/or varnish coating 9 which is to be hardened.

In a manner such as is suggested in FIG. 1 of the aforementioned published article in Applied Physics, the discharge space 6 between the electrode 3 and the dielectric wall 5 is filled with a filler gas which emits UV radiation under discharge conditions, e.g. mercury vapor, a noble gas, a noble-gas/metal-vapor mixture or a noble-gas/halogen mixture and, if necessary or desirable, an additional noble gas, such as argon, helium, neon or xenon is used as buffer gas. It is possible to vary the filler gas, depending upon the desired spectral composition of the radiation.

When a voltage is applied between the electrodes 2 and 3, a multiplicity of so-called silent discharges take place in the discharge space 6. UV light is emitted during these discharges and is able to penetrate the dielectric wall 5. In addition, due to the specific arrangement of the electrodes, so-called external discharges take place in the external space between the dielectric wall 5 and the grid electrode 2. Depending upon the ambient atmosphere, these external discharges produce reaction products as well as ions, mainly ozone and oxides of nitrogen in air, which, together with the UV radiation from the discharge space 6, markedly accelerate the hardening of the ink and/or varnish coating 9 on the substrate material 10, that is, they act, so to speak, as catalysts.

The adjustable arc voltage is in the order of magnitude of several kV. The usual frequency thereof is in the 100-kHz range and depends upon the electrode geometry, the pressure in the discharge space and the composition of the filler gas. By varying the discharge voltage and/or the discharge frequency and/or the distance between the electrodes 2 and 3 and/or the distribution of the electrodes 2 and 3, it is possible to produce either a multitude of by-products (heavy external discharge with high voltage) or only negligibly few or even no by-products at all.

Figure 2A:
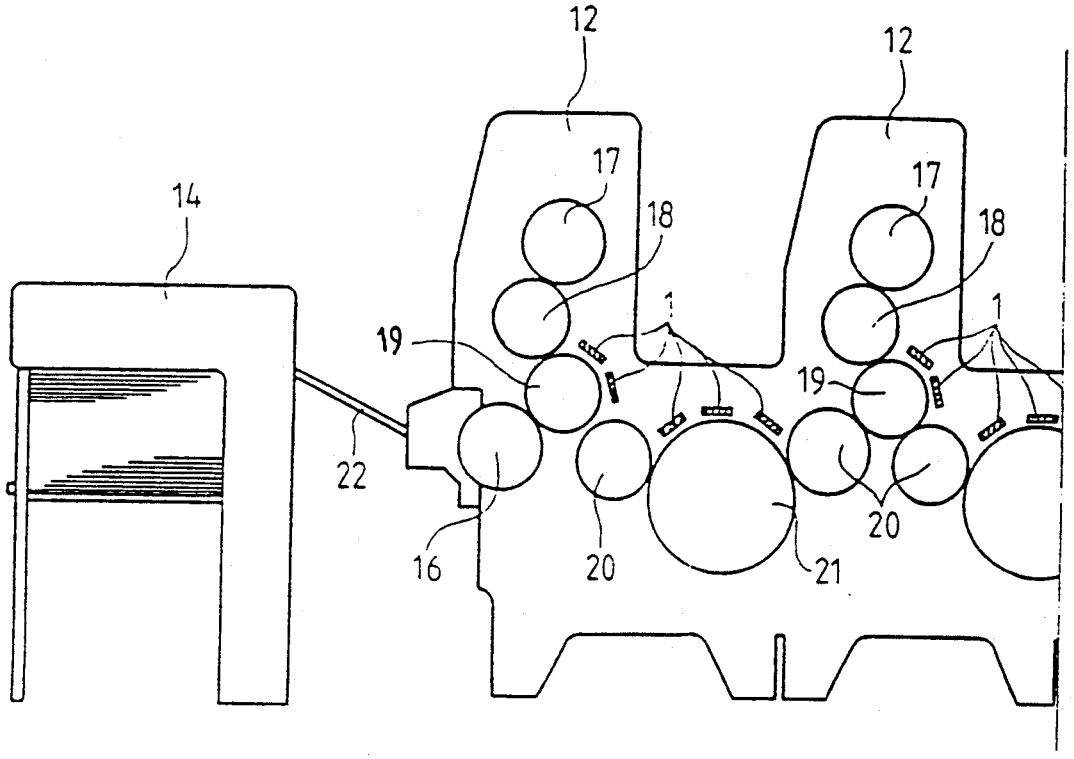
FIGS. 2*a* and 2*b* taken together constitute a diagrammatic longitudinal sectional view of a printing press with integrated radiator devices or radiation-lamp appliances.
Figure 2B:
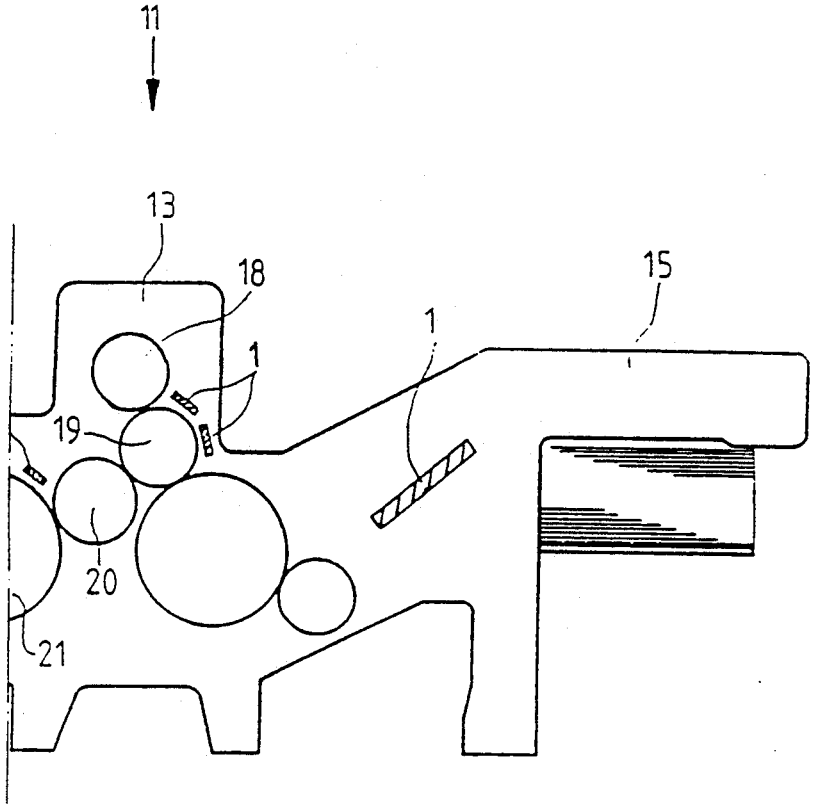

FIGS. 2*a* and 2*b* together are a longitudinal sectional view of a sheet-fed rotary printing press 11 with two printing units 12, a varnishing unit 13, a feeder 14 and a delivery 15. Sheets 10 are accepted from a feed table 22 by a gripper system of a register feed drum 16 and are transported from printing unit 12 to printing unit 12 via transfer cylinders 20 and turning drums 21. From an inked printing form, which is mounted on a plate cylinder 17, a subject is transferred to a rubber-blanket cylinder 18, from which it is applied to the sheet 10 to be printed. At high press speeds, there is a danger that the ink and/or varnish 9 will have not yet become dried and/or hardened by the time it comes into contact with the outer cylindrical surface of the transfer cylinder 20 or, in the case of perfector printing, with the outer cylindrical surface of the turning drum 21 and of an impression cylinder 19. This applies as well to the varnish coating which is applied in the varnishing unit 13 directly from the rubber-blanket cylinder 18 onto the printed sheet 10. To prevent setting-off of the ink and/or varnish coating 9, the radiator devices 1 according to the invention are assigned to the impression cylinder 19. The yet damp side of the sheet 10 is hardened and/or dried immediately. Because excimer radiation lamps, which are integrated into the radiator devices 1, are ready for operation immediately after they have been initially switched on or switched on again after they had just been switched off, it is possible to provide additional radiator devices 1 which are assigned, for example, to the turning drums 21 or to the delivery 15 and, if required, assist in the drying and/or hardening process.

The foregoing is a description corresponding in substance to German Application P 40 10 191.6, dated Mar. 30, 1990, the International priority of which is being claimed for the instant application, and which is hereby made part of this application. Any material discrepancies between the foregoing specification and the aforementioned corresponding German application are to be resolved in favor of the latter.

We claim:

1. In a printing press having a plurality of printing units with respective impression cylinders for carrying thereon substrate material having a coating of ink and/or varnish, at least one radiator device for drying and/or hardening coatings of ink and/or varnish comprising a high-power radiator disposed in direct vicinity of a respective substrate-carrying impression cylinder, said radiator having an electrode pair connected to an alternating-current voltage source, and a wall intermediate the pair of electrodes and defining a gas-filled discharge space, said wall being formed of dielectric material and being transparent to radiation generated in the discharge space, said wall of dielectric material being disposed in direct vicinity of one of said two electrodes, so that electrical energy capacitively injected from said one electrode into said discharge space causes additional discharges outside of said discharge space, said additional discharges having a catalytic effect on the drying and/or hardening process, the respective impression cylinder being at ground potential so that charged reaction products formed by said additional discharges flow towards the respective impression cylinder and dry and/or harden the coating on the substrate carried thereby.

2. Radiator device according to claim 1, wherein the radiator is a planar excimer radiation lamp and said one electrode is a grid electrode connected under high voltage and is disposed in direct vicinity of a location at which an ink and/or varnish coating to be hardened is disposed.

3. In a printing press having a plurality of printing units with respective impression cylinders, at least one radiator device for drying and/or hardening coatings of ink and/or varnish in a printing press, comprising a high-power radiator having an electrode pair connected to an alternating-current voltage source, and a wall intermediate the pair of electrodes and defining a gas-filled discharge space, said wall being formed of dielectric material and being transparent to radiation generated in the discharge space, said wall of dielectric material being disposed in direct vicinity of one of said two electrodes, so that electrical energy capacitively injected from said one electrode into said discharge space causes additional discharges outside of said discharge space, said additional discharges having a catalytic effect on the drying and/or hardening process, said radiator device being assigned to each of said impression cylinders, and including turning drums and a delivery, and at least another radiator device assigned to said turning drums and said delivery.

4. Printing device according to claim 1, including means for selectively switching said radiator devices on and off.

* * * * *